United States Patent [19]

Brimhall

[11] 4,142,711

[45] Mar. 6, 1979

[54] FENCE AND FENCE POST WITH REMOVABLE RAIL RETAINING BRACKET

[76] Inventor: Rulon W. Brimhall, 773716 W., Provo, Utah 84601

[21] Appl. No.: 849,476

[22] Filed: Nov. 7, 1977

[51] Int. Cl.[2] ..... E04H 17/00

[52] U.S. Cl. ..... 256/65; 256/19; 403/346

[58] Field of Search ..... 256/19, 55, 59, 65, 256/66, 69, 68; 248/218.3, 218.4; 403/346

[56] References Cited

U.S. PATENT DOCUMENTS

| | | | |
|---|---|---|---|
| 133,853 | 12/1872 | Hall | 256/59 |
| 365,099 | 6/1887 | Richart | 256/69 |
| 436,539 | 9/1890 | McKee, Jr. | 256/66 |
| 590,100 | 9/1897 | Grant | 256/66 |
| 760,882 | 5/1904 | Litzinger | 256/66 |
| 2,338,090 | 1/1944 | Bradfield | 403/346 X |
| 2,578,165 | 12/1951 | Bailey | 256/19 |
| 3,989,226 | 11/1976 | Burgess | 256/65 |

FOREIGN PATENT DOCUMENTS

| | | | |
|---|---|---|---|
| 1482517 | 8/1977 | United Kingdom | 256/66 |

*Primary Examiner*—Andrew V. Kundrat
*Attorney, Agent, or Firm*—Shlesinger, Arkwright, Garvey & Dinsmore

[57] ABSTRACT

A fence is disclosed having posts with grooves which receive an enclosure or sleeve into which the fence rail end portions are inserted. The enclosure or sleeve may be held by a retaining bolt which passes through the post at the location of the groove in the exterior surface of the post. The post may be made of subsequently hardening settable material such as concrete. In such case the post may have a centrally cast rod with a bolt secured at right angles to the rod so as to protrude out of the surface of the post. Alternatively, the bolt may pass completely through the post and the enclosure or sleeve.

1 Claim, 4 Drawing Figures

FENCE AND FENCE POST WITH REMOVABLE RAIL RETAINING BRACKET

BACKGROUND AND FIELD OF INVENTION

This invention relates to fences of the type wherein a rail is supported parallel to the ground by inserting its end portions into holes in adjacent vertical posts. This invention can be used with concrete fence posts.

In the past it has been difficult to replace broken rails in this type of fence. Usually it was necessary to dig up one of the posts adjacent the broken rail in order to insert the replacement rail.

Another problem has been that wood fence posts tend to be adversely affected by moisture, weather, dry rot and insects. Among the solutions proposed have been the use of special wood varieties, chemical coating and alternate materials. Some species of wood, for example redwood, do ameliorate the durability problem but they do not eliminate it. Chemical coating is effective but the coating must be periodically reapplied to have continued effect and this usually requires removal of fence posts from the ground. Use of alternate materials such as metal and concrete is promising. However, metals are expensive and are subject to rust if they are not painted regularly. Concrete offers durability but so far such posts have not been extensively used because of the difficulty of attaching rails to these posts.

Prior art efforts to develop effective concrete fence posts include U.S. Pat. No. 859,239 to McFall, U.S. Pat. No. 3,451,657 to Roberts, U.S. Pat. No. 2,969,223 to Hansen, U.S. Pat. No. 984,711 to Stanley, and U.S. Pat. No. 2,578,165 to Bailey.

De Ridder in U.S. Pat. No. 3,276,750 discloses a fence in which rails are maintained by U-shaped mounting brackets. British Pat. No. 1,336,012 discloses a fence in which a wire is clamped to a post.

OBJECTS AND SUMMARY OF INVENTION

It is an object of this invention to provide a means for facilitating replacement of broken fence rails.

It is a further object to develop such a fence which can be made of subsequently hardening settable material.

It is a still further object of this invention to create such a fence which will be economical and extremely durable.

Another object of this invention is to provide a fence post which need not be removed from the ground in order to replace the rails.

Yet a further object of this invention is to provide means for securing fence rails to posts which can be readily removed from the posts so that rails may be inserted in the means and subsequently the assembled rails and securing means secured to said posts.

Another object is to provide means in said posts which will provide maximum strength to said rails at the point of securement so that downward thrust on said rails or said securing means for said rails will not cause said rails or said securing means to be ripped from said posts.

These objects are achieved in a fence having posts which have a grooved surface to receive the end portions of rails. The rail end portions are retained by a sleeve or enclosure which may be bolted into the grooves formed in the surface of the posts.

The posts may be made of subsequently hardening settable material such as concrete. In one embodiment a reinforcing rod is cast in a concrete post. The rod may have bolts welded to it at right angles so as to protrude out of the surface of the post in order to retain the sleeve. Alternatively, a bolt may pass completely through the post and the sleeve, the sleeve being held to the post by the bolt head on one side and a nut on the other.

DESCRIPTION OF THE PREFERRED EMBODIMENT

Figure 1:
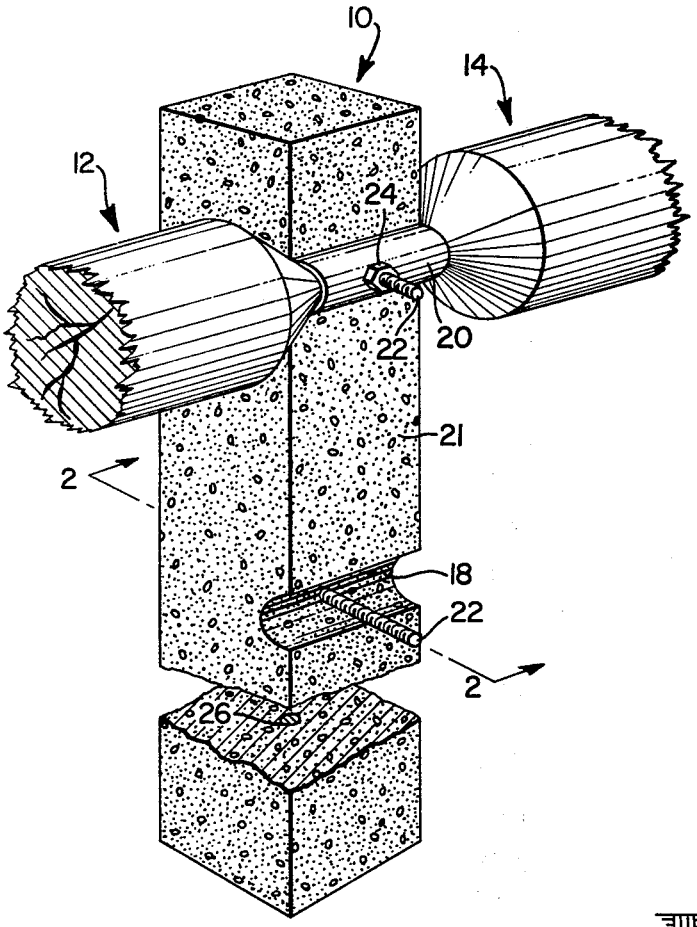
FIG. 1 is a perspective view with a cut-away section of one embodiment.
Figure 2:
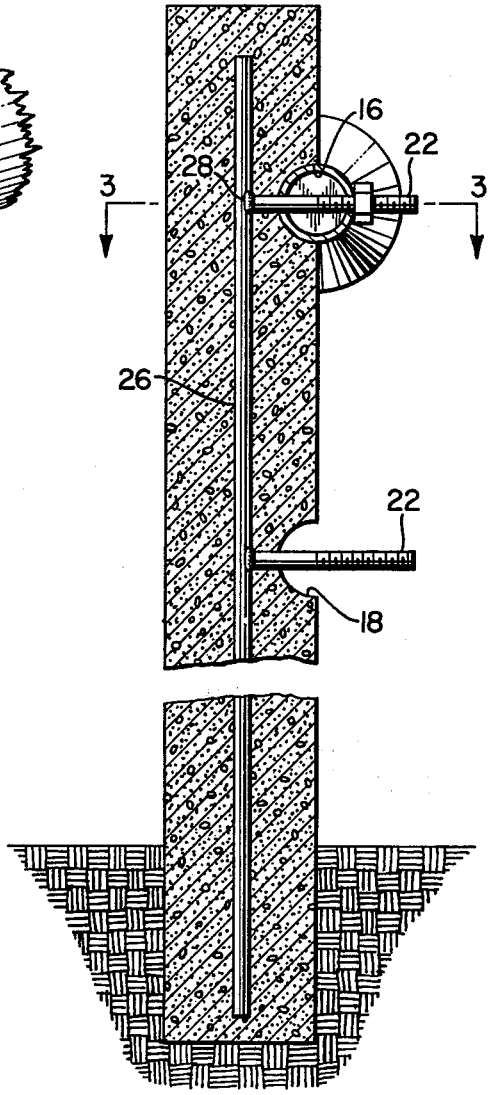
FIG. 2 is a cross-section taken along the plane 2—2 in FIG. 1 and viewed in the direction of the arrows.

In FIG. 1 a fence post 10 is shown supporting rails 12 and 14 partially shown. The cross-section of the post 10 may be a square, a circle, or any polygon. FIGS. 1 and 2 show that the post 10 has an upper semicircular groove 16 and a lower semicircular groove 18. The grooves 16 and 18 extend across the face 21 of the post parallel to the ground. Upper cylindrical enclosure or sleeve 20, preferably a section of steel pipe, fits into upper groove 16 while an identical lower cylindrical enclosure or sleeve, not shown, would fit into lower groove 18. As will be described more fully later, the cylindrical enclosure 20 may be secured to the post 10 by a bolt 22 and nut 24. The lower end of the post 10 which is buried in the earth, may be flared or bell-shaped to better secure the post in the earth.

The post 10 may be made of subsequently hardening settable material including earth or plastic composition material such as concrete, cement, clay, epoxy, rubber, or the like. If the post 10 is made of subsequently hardening settable material the upper and lower circular grooves 16 and 18 may be molded in the posts. Furthermore as shown in FIG. 2 a reinforcing rod 26 may be cast into the post 10. The rod 26 runs through almost the entire length of the post. Bolts 22 may be welded as at 28 to the rod 26 so as to extend perpendicular to the rod 26 and protrude through the surface of the post 10 at the location of an upper or lower circular groove 16 or 18.

Figure 3:
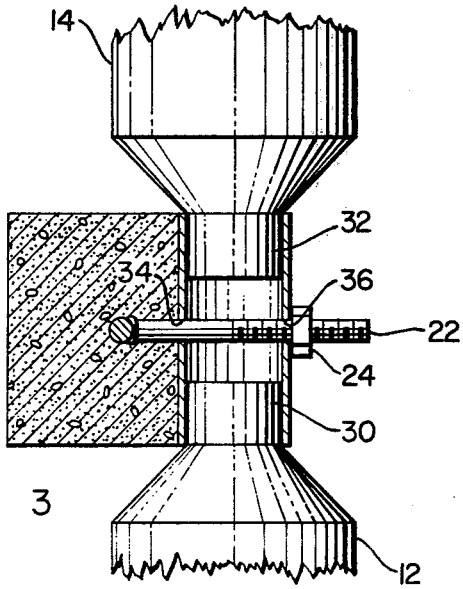
FIG. 3 is a cross-section taken along the plane 3—3 in FIG. 2 and viewed in the direction of the arrows.

FIG. 3 illustrates how the fence works. Rails 12 and 14 have narrowed cylindrical end portions 30 and 32 respectively which may be inserted into cylindrical enclosure 20. Cylindrical enclosure 20 is then pushed into the circular groove 16 with bolt 22 sliding through holes 34 and 36 in the cylindrical enclosure 20. The cylindrical enclosure 20 is then secured to the post 10 with nut 24. If a rail is broken a new rail can be inserted simply by removing the cylindrical enclosure 20, inserting a new rail and then replacing the cylindrical enclosure 20 on its mounting.

Figure 4:
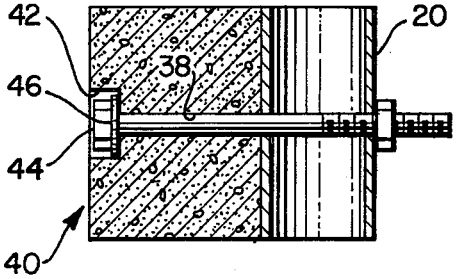
FIG. 4 is a cross-section of an alternate embodiment taken along the same plane shown by FIG. 3.

FIG. 4 shows an alternate means for bolting the cylindrical enclosure 20 to the post 10. In this embodiment a hole 38 is cut for formed in the post 10 at the location of a semicircular groove 16 or 18. On the side 40 of the post 10 opposite the groove 16 or 18 a counterbored region 42 may be cut out or molded into the post 10 so as to accept the head 44 of the bolt 22 in a recessed position in the post 10. A washer 46 may also be included. Cylindrical enclosure 20 is attached in the same manner as described with respect to the embodiment illustrated by FIG. 3.

It should be noted that the groove 16 or 18 is sufficiently deep to permit a load to be carried safely on the upper portion of the rail without the rail or sleeve 20 being stripped or pulled away from the post. The lower portion of the groove and thus the post itself supports the load. The groove should be at least about a radius of the sleeve in depth and the sleeve should nest therein.

While this invention has been described as having a preferred design, it will be understood that it is capable of further modification. This application, is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A fence post for supporting fence rails having:

(a) said post being rectangular in horizontal cross-section;

(b) a plurality of similar arcuate recesses in one face of said post spaced one above the other;

(c) said recesses extend from one edge from said post to the other edge of said post;

(d) a plurality of equal diameter cylindrical sleeves positioned in each of said recesses and each having its axis perpendicular to the longitudinal axis of said post;

(e) said recesses having a depth of at least one-half the width of said sleeve;

(f) a plurality of bolts secured in said post perpendicular to said longitudinal axis of said post and parallel to each other, extending outwardly through said recesses and substantially beyond said one face of said post, and each centrally positioned in its respective recess;

(g) said sleeves being substantially equal in length and being in length substantially the width of said post;

(h) said sleeves having cooperating bolt holes on opposite sides thereof and positioned on said bolts;

(i) means for removably securing said sleeves on said bolts and for maintaining said sleeves in their respective recesses when supporting said fence rails; whereby (j) said fence rails are form fitted into the end of said sleeves and surroundingly supported thereby.

* * * * *